US011603981B2

(12) United States Patent
Rosen et al.

(10) Patent No.: US 11,603,981 B2
(45) Date of Patent: Mar. 14, 2023

(54) MULTIPLE CHANNEL LENS COMBINATION MULTI-FOCUS LED LIGHT AND METHOD

(71) Applicant: VIDENDUM PRODUCTION SOLUTIONS INC., Chatsworth, CA (US)

(72) Inventors: Richard Allen Rosen, Simi Valley, CA (US); Victor Hau Chen, Marina Del Rey, CA (US)

(73) Assignee: Videndum Production Solutions Inc., Chatsworth, CA (US)

( * ) Notice: Subject to any disclaimer, the term of this patent is extended or adjusted under 35 U.S.C. 154(b) by 0 days.

(21) Appl. No.: 15/489,692

(22) Filed: Apr. 17, 2017

(65) Prior Publication Data

US 2017/0299144 A1 Oct. 19, 2017

Related U.S. Application Data

(60) Provisional application No. 62/323,581, filed on Apr. 15, 2016.

(51) Int. Cl.

| | |
|---|---|
| ***F21V 5/00*** | (2018.01) |
| ***H05B 45/10*** | (2020.01) |
| ***F21Y 115/10*** | (2016.01) |
| ***F21Y 105/10*** | (2016.01) |
| ***F21S 8/00*** | (2006.01) |

(52) U.S. Cl.

CPC ..... *F21V 5/007* (2013.01); *F21S 8/003* (2013.01); *H05B 45/10* (2020.01); *F21Y 2105/10* (2016.08); *F21Y 2115/10* (2016.08)

(58) Field of Classification Search

CPC ..... F21V 14/04; F21V 14/045; F21V 14/06; F21V 14/065; F21V 5/007; F21Y 2105/10; F21S 8/003; H05B 47/155

See application file for complete search history.

(56) References Cited

U.S. PATENT DOCUMENTS

| | | | | |
|---|---|---|---|---|
| 4,345,308 A * | 8/1982 | Mouyard | G09F 13/22 | 362/245 |
| 8,047,676 B2 * | 11/2011 | Cheng | F21V 5/002 | 362/240 |
| 8,721,115 B2 * | 5/2014 | Ing | G09F 13/14 | 362/241 |
| 8,794,792 B1 * | 8/2014 | Moghal | F21V 29/507 | 362/240 |
| 2002/0171365 A1 * | 11/2002 | Morgan | H05B 47/10 | 315/56 |
| 2003/0053310 A1 * | 3/2003 | Sommers | F21V 5/006 | 362/231 |

(Continued)

*Primary Examiner* — Eric T Eide

(74) *Attorney, Agent, or Firm* — Scott R. Zingerman; GableGotwals

(57) ABSTRACT

The present disclosure is an improvement in bi-focus lenses. The disclosure relates to the use of multiple channels of LED/Lens combinations to achieve a smooth and continuous range of emitted beam angles of light in a wider range of beam angles than previously possible through only two channels of LED/Lens combinations. The resultant product will produce a continuous range of beam angles in a range exceeding 35 degrees from narrowest bean angle to widest beam angle. The lens channels selected are weighted so as to maximize the contribution of a single channel lens to the overall beam projection.

20 Claims, 7 Drawing Sheets

(56) References Cited

U.S. PATENT DOCUMENTS

| | | | | |
|---|---|---|---|---|
| 2005/0128751 | A1* | 6/2005 | Roberge | F21K 9/00 362/276 |
| 2013/0100678 | A1* | 4/2013 | Baxter | F21V 13/02 362/311.06 |
| 2014/0185285 | A1* | 7/2014 | Jorgensen | F21V 14/02 362/232 |

* cited by examiner

MULTIPLE CHANNEL LENS COMBINATION MULTI-FOCUS LED LIGHT AND METHOD

CROSS REFERENCE TO RELATED APPLICATION

This application claims the benefit of U.S. Provisional Application No. 62/323,581 filed Apr. 15, 2016, herein incorporated by reference in its entirety for all purposes.

FIELD OF THE INVENTION

This invention relates to improvements in bi-focus lenses. More specifically, this invention relates to bi-focus lenses for use in lights adapted for use in theatre, film, television, and image capture applications.

BACKGROUND OF THE INVENTION

Litepanels LLC, Chatsworth, Calif., part of Vitec Videocom, has previously produced and sold continuously-adjustable multiple beam-angle LED light panels whose performance has been commercially successful, particularly in the film, television, theatrical, and image capture industries. The Litepanels bi-focus LED panel lights with 5 mm LEDs is presently the state of the art.

Other attempts at bi-focus technology with a range of performance have met limited success. Shortcomings of previous bi-focus LED lighting technologies are the limited range of focus, or beam angles. A 20 degree range is presently all that is considered possible for a smooth continuous sweep of beam angles. A panel light projecting a smooth continuous beam angle sweep from 15 degrees, or even more narrow, to up to 50 degrees, or wider, would simulate the performance of a Fresnel light with a panel light and is needed in the art. An additional need exists for a multi-focus, multi-channel panel light.

SUMMARY OF THE INVENTION

The present disclosure and invention is the use of multiple channels of LED/Lens combinations to achieve a smooth and continuous range of emitted beam angles of light in a wider range of beam angles than previously possible through only two channels of LED/Lens combinations.

The present disclosure is an improvement in and to bi-focus lenses. The disclosure relates to the use of multiple channels of LED/Lens combinations to achieve a smooth and continuous range of emitted beam angles of light in a wider range of beam angles than previously possible through only two channels of LED/Lens combinations. The resultant product will produce a continuous range of beam angles in a range exceeding 35 degrees from narrowest bean angle to widest beam angle.

The present disclosure includes a light panel including an array of LEDs. Preferably the LEDs are arranged in a module. Multiple modules are arranged into a panel array. The panel array is integrated into a housing to form a light panel. At least one processor and output circuitry place the processor in communication with the panel array and input selection means, such as knobs or the like as well as DMX control.

A plurality of primary beam angles are interweaved throughout the modules which form the panel array. In a preferred embodiment, four primary beam angles are interweaved throughout the array. These primary beam angles are combined to vary the total output beam angle of the light panel. In a broad arrangement beam angles may range between 8° and 120°, and more preferably between 10° and 100°, and most preferably 10° and 80°.

The following advantages are contemplated by the present invention:

1.) High level of beam integration to eliminate color variations across the beam.
2.) Even intensity across the center of the projected beam for all beam angles.
3.) Steep falloff at the edges of the projected beam for an effective SPOT effect.
4.) As much as possible, light emitted uniformly from the entire panel array to minimize multiple shadows, near-field anomalies, and narrow beam emission that offends an observer's eyes.
5.) Reduction of color over angle.

The lens channels selected are weighted so as to maximize the contribution of a single channel lens to the overall beam projection. The lower beam angles have a higher weighting in the sense that a small contribution of a lower beam angle may result in larger change to the overall beam projection. The choice of static lens beam angles depends on where the continuity of the beam angle is most desired. As a result, a lens beam angle selection for four primary channels may include 10°, 20°, 40° and 80° or any angle in between, for example. As a result, a light panel with a smooth continuous sweep of 110°, 80°, 60°, or anywhere in between is contemplated.

All of the above are intended to produce a goal of a blended, homogeneous light across the panel array when multiple lenses are used. This results in even and smooth adjustment between various beam angles.

The foregoing has outlined in broad terms the more important features of the invention disclosed herein so that the detailed description that follows may be more clearly understood, and so that the contribution of the instant inventors to the art may be better appreciated. The instant invention is not limited in its application to the details of the construction and to the arrangements of the components set forth in the following description or illustrated in the drawings. Rather the invention is capable of other embodiments and of being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention.

DETAILED DESCRIPTION OF THE PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

Figure 1:
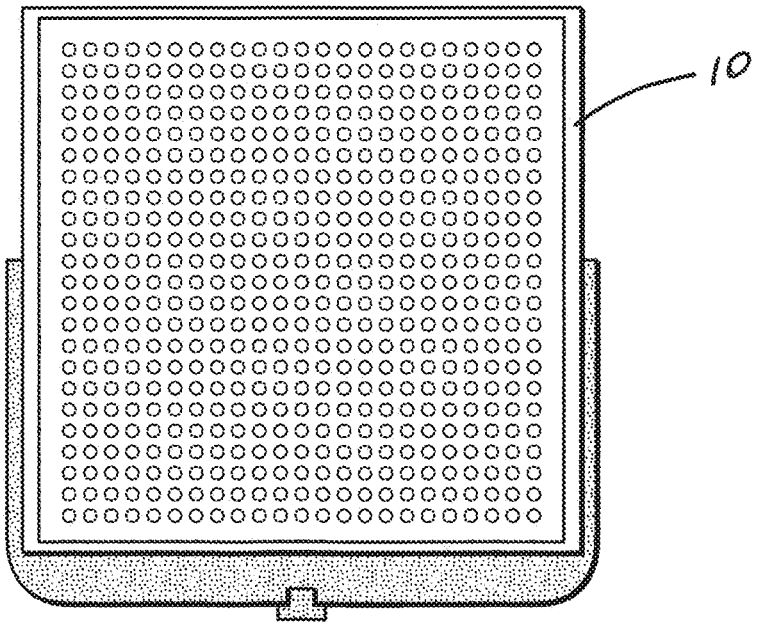
FIG. 1 is an isometric view of a multiple channel lens combination multi-focus LED panel light of the present disclosure.
Figure 2:
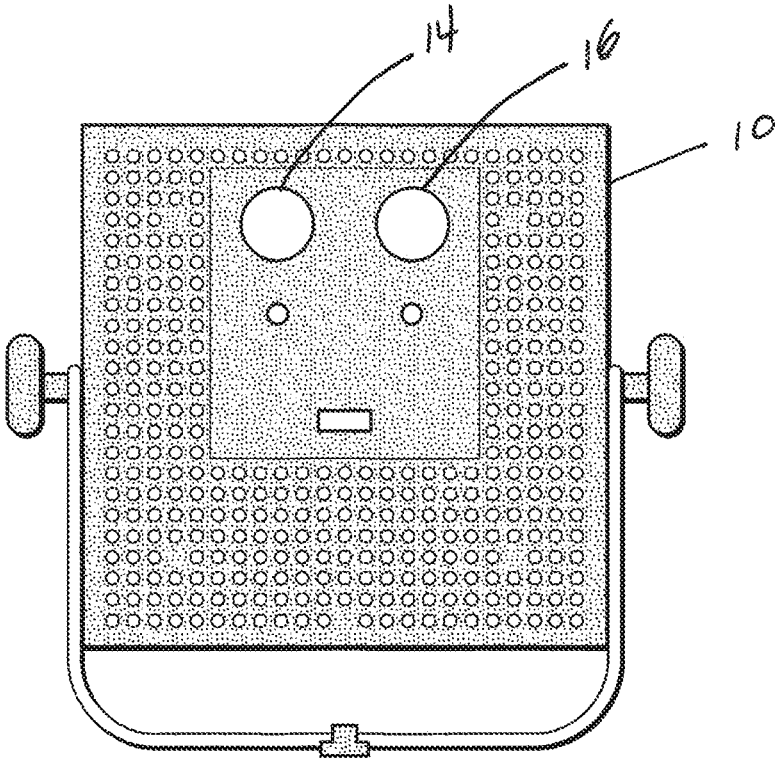
FIG. 2 is a back view of the multiple channel lens combination multi-focus LED panel light of FIG. 1.
Figure 3:
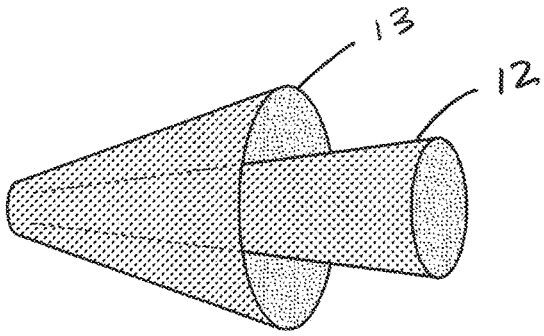
FIG. 3 is an isometric illustration of spot and flood light beams.

With reference to FIGS. 1-3, the invention of the present disclosure is particularly suited for implementation into an LED panel light, such as a 1×1 (one-foot by one-foot) in a preferred embodiment. LED panel light 10 is, in a preferred embodiment, ultra-thin and portable and may be used as an alternative to energy inefficient lights, such as Fresnel lights. LED panel light 10 offers the flexibility to instantly vary the width of the projected light beam between spot 20 and flood 30 (FIG. 3). An exemplary 1×1 bi-focus LED panel light 10 remains cool to the touch, and consumes a small fraction of the power used by traditional lighting fixtures. The 1×1 multi-focus LED panel light 10 of the preferred embodiment includes multiple independent sets of color balanced LED bulbs set in the one-foot by one-foot square of the fixture. The multiple sets of LEDs is comprised of bulbs including lenses, varying between spot and flood. Adjustment of the spot and flood setting of the light fixture is achieved via an integrated DMX controller, or by turning a manual control dial 14 on the back of the fixture 10 (FIG. 2). LED panel light 10 may also provide infinite dimming from 100 percent to zero percent with minimal change in color temperature. Brightness can also be controlled by a built-in dimmer dial 16 on the back of the housing of light 10 or by a DMX controller. LED panel light 10 may also preferably alternatively run on battery power using an onboard battery pack (not shown), or AC power.

A major factor in the quantification of a multiple focus light's performance is the light's ability to emit circular and homogenous light beams throughout a selected/desired range of beam widths. It has been found to be difficult to achieve beam quality through a larger range of beam angles because the two types of lenses do not superimpose respective light beams well, thus, at mid-beam-angle setting, the superimposed beam angles lose their circularity and homogeneity. In other words, it becomes visually apparent that one light beam is superimposed upon another because they each retain their respective boundaries and intensities and do not appear blended.

A solution to this problem in accordance with the present disclosure is to add intermediate beam-angles to the composite beam. The addition of a 3rd, or 4th, or more channels of LED electronics, plus LEDs, plus optics will improve the quality of the composite beam along a wider range of beam angles.

In developing a light fixture that possesses the capability to output more than one beam-width of light, many measures must be taken to insure that the intermediary "mixed" beam widths from emitters of discrete beam widths are mixed such that a perceptually smooth transition is made. Factors such as optics design choices and LED driver dim curves all contribute to this perceptual smoothness. The lens channels selected are weighted so as to maximize the contribution of a single channel lens to the overall beam projection. The lens channels selected are weighted so as to maximize the contribution of a single channel lens to the overall beam projection. The lower beam angles have a higher weighting in the sense that a small contribution of a lower beam angle may result in larger change to the overall beam projection. The choice of static lens beam angles depends on where the continuity of the beam angle is most desired. As a result, a lens beam angle selection for four primary channels may include 10°, 20°, 40° and 80°, for example.

FIG. 3 depicts a common relationship between light projected at a narrow beam angle, such as spot 12, and a wide beam angle such as flood 13. It is understood that lenses with narrow beam angles produce more intense, light, such as 12, with a longer throw that can be projected further than lenses with wide beam angles which produce less intense light over a wider area with less throw, such as 13. A problem with present bi-focus lights is that in a transition between spot 12 and flood 13, light is projected with two visible intensities. As a result, the multi-channel embodiments of the present disclosure are intended to eliminate these visible distinctions for a smooth transition. Being more intense, the lens channel selections of the present disclosure may be weighted toward narrow beam angles so as to provide a fixture with sufficient throw while maintaining a smooth transition.

Figure 4:
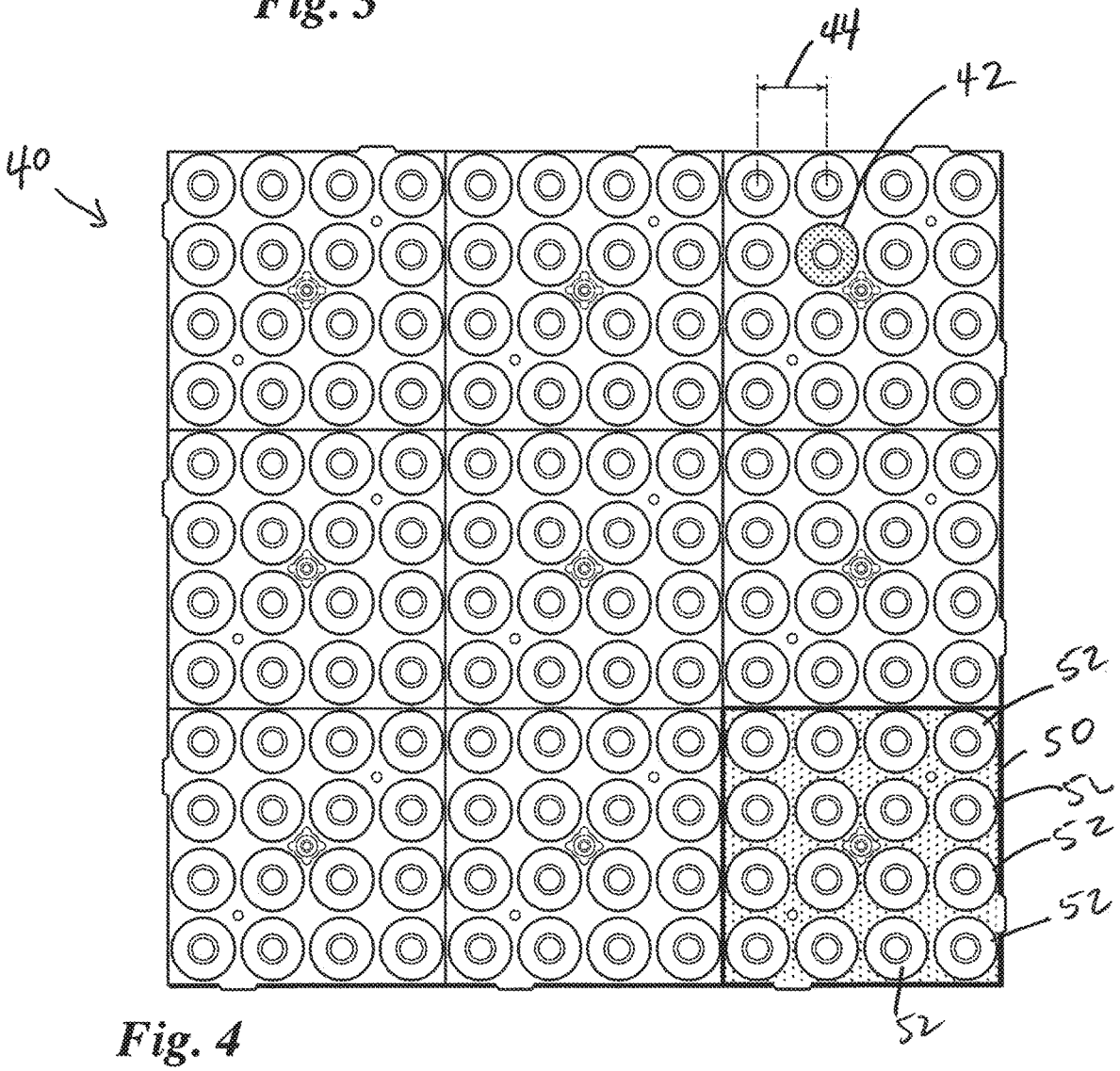
FIG. 4 depicts an array of modules each including an array of LED light bulbs.

FIG. 4 depicts a light panel array 40 including an array of modules 50. Light panel array 40 could be included in light panel 10 and FIGS. 1 and 2. Exemplary panel array 40 of FIG. 4 depicts a plurality of modules such as module 42. Each module, such as module 50 includes a plurality of optics, such as 42. Optics are arranged in an array having an optical pitch 44. Each optic includes at least one LED lens, collectively 52 arranged in an array (see FIG. 5). In module 50, 16 such lenses 52 are arranged in an array. LEDs are positioned to emit light from lenses 52. Lenses 52 may or may not include the same beam angle such that light emitted from the respective LEDs passing through a respective lenses 52 may or may not be projected at the same beam angle. For example, FIG. 6 depicts a module 60 wherein two sets of lenses, 62 and 64 are positioned in an array. Lenses 62 have a different beam angle than lenses 64.

Figure 5:
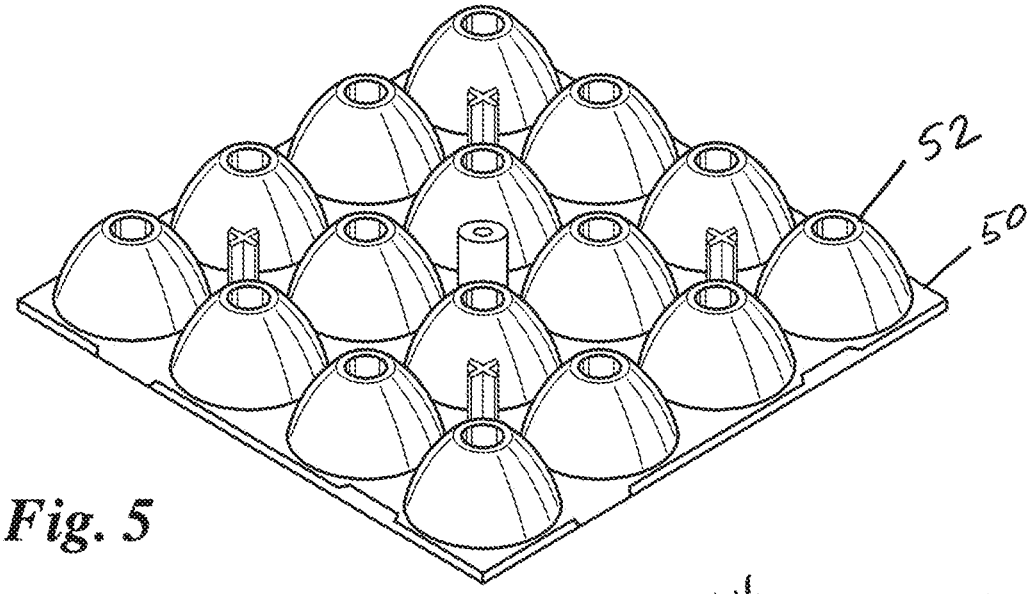
FIG. 5 is an isometric view of a module of FIG. 4.
Figure 6:
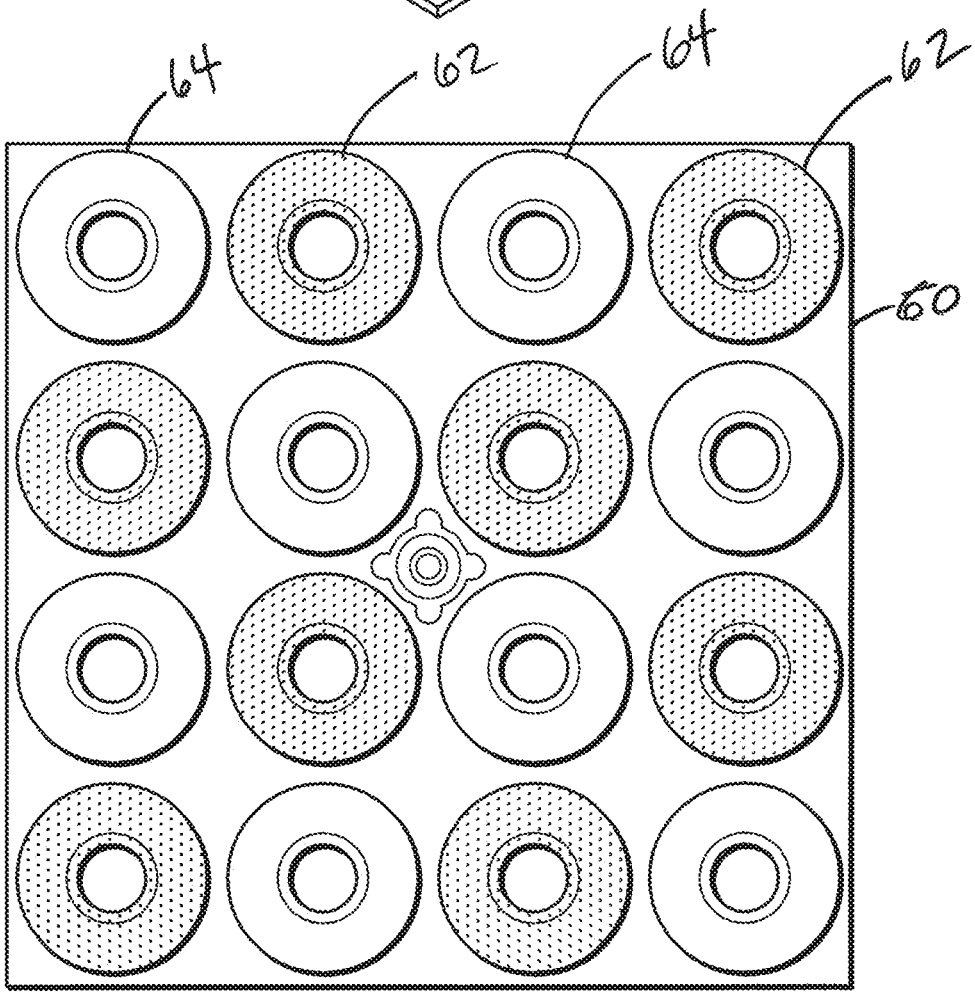
FIG. 6 depicts the module of FIG. 5 and illustrates the alternating array of spot and flood LED's.

FIGS. 5 and 6 depict one such module 50. Module 50 contains an array of LEDs including multiple lenses which vary from spot to flood.

Figure 9:
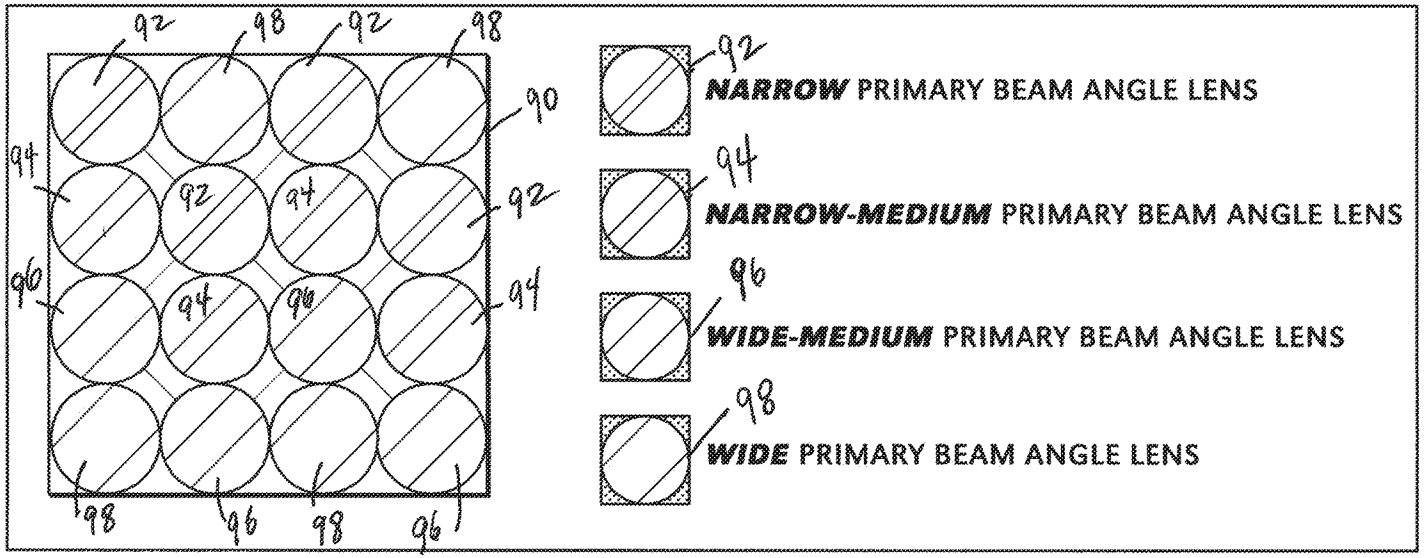
FIG. 9 depicts an embodiment module including multiple lenses; each having one of four primary beam angles.

FIG. 9 depicts a preferred arrangement LED module 90 of the present disclosure including four different and distinct lenses. These four different lenses are arranged in module 90 such that there are four of each lens in module 90 for a total of 16 lenses. As depicted, the four different lenses including a narrow beam angle lens 92 (such as 10°) a narrow-medium beam angle lens 94 (such as 25°), a wide-medium beam angle lens 96 (such as 40°), and a wide beam angle lens 98 (such as 65°).

It should be understood that the lenses described are exemplary. The spacing between beam angles does not, necessarily have to be even. In fact, it is anticipated that the channels are selected such that they are weighted, such as toward narrow beam angles.

As shown in module 90, there are four of each primary lenses, collectively and respectively, 92, 94, 96, and 98, arranged in an array in module 90. In a preferred arrangement, lenses 92, 94, 96, and 98 may be positioned in an interwoven arrangement to form an array. It should be understood, however, that the beam angle of any particular lens could vary as desired. Moreover, the number of different lenses could vary with a desired number of channels. In addition, the number and arrangement of each respective lens 92, 94, 96, and 98 could be varied as desired/required. Moreover, a bi-color fixture could be created by adding LEDs of differing output temperature and their respective lenses to the panel array.

Figure 10:
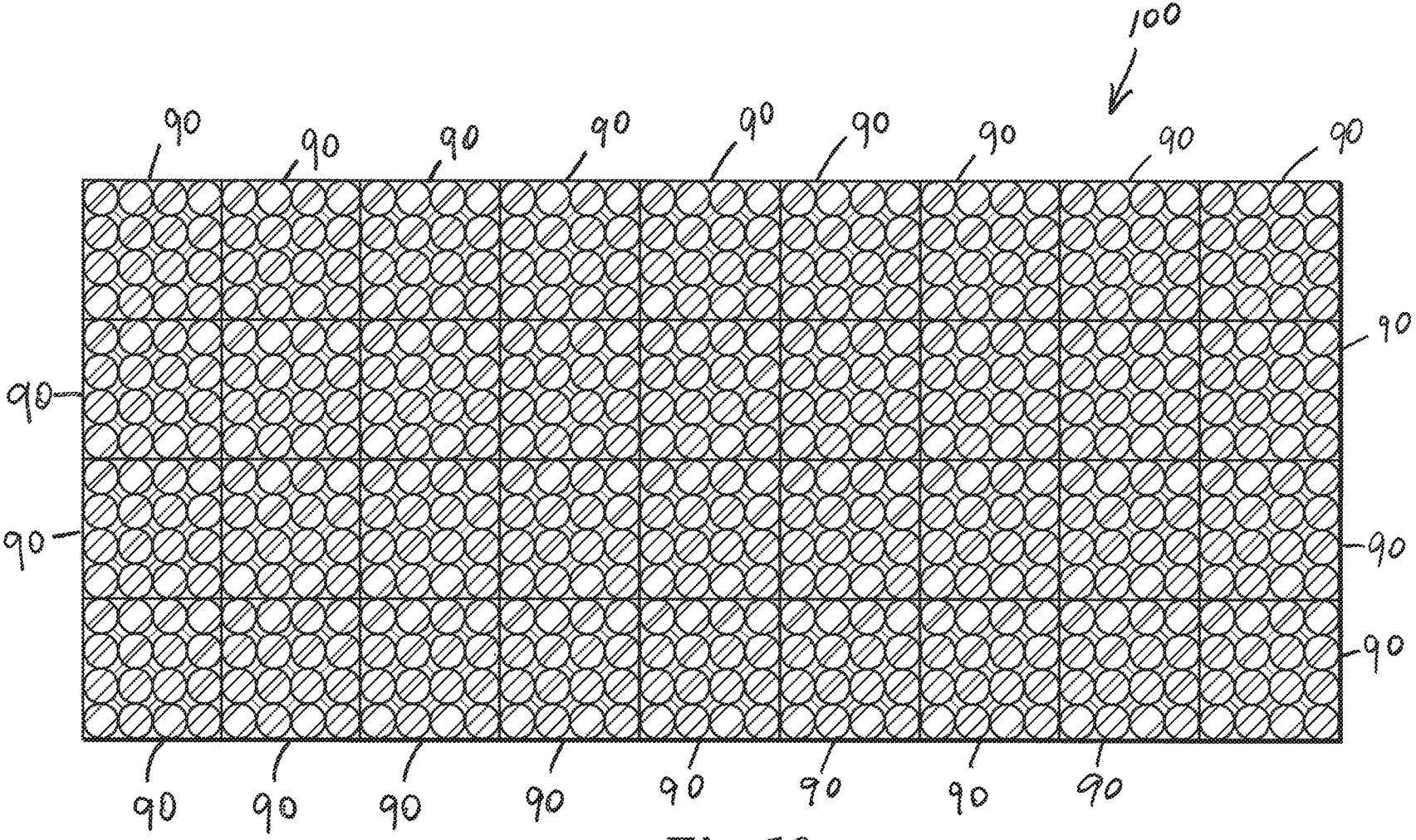
FIG. 10 depicts an array of modules of FIG. 9.

FIG. 10 depicts a preferred embodiment array of modules, collectively 90 (from FIG. 9) arranged in an array to form a light panel 100. However, it should be understood that each respective module 90 could include a different array of individual lenses as desired. Such selection is influenced by factors such as, without limitation, manufacturing costs, ease, aesthetics, and particularly to provide a smooth transition between spot/flood using multi-channels according to the present invention.

Figure 8:
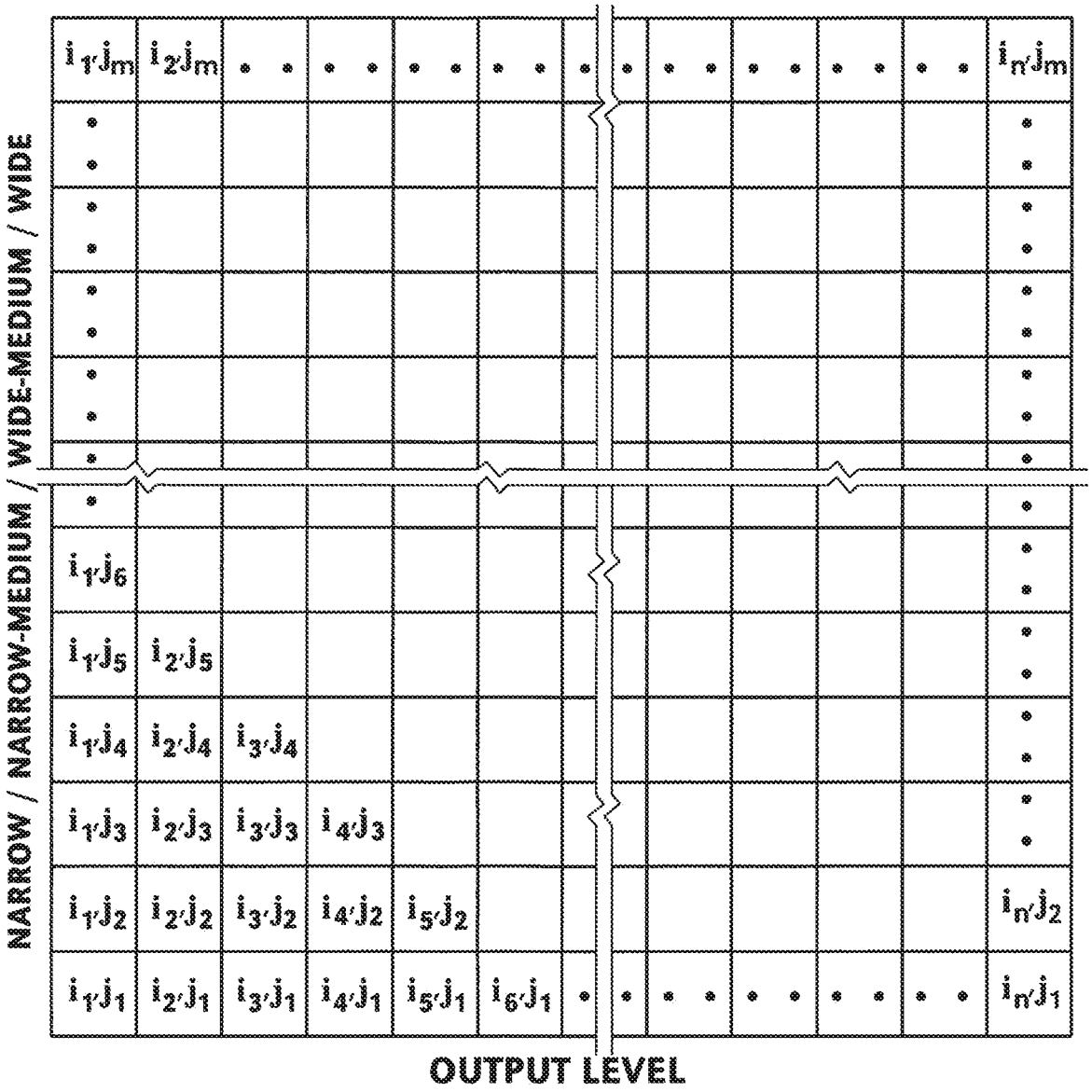
FIG. 8 depicts a look up table depicting spot channel and flood channel as a function of spot/flood setting and output level setting.

FIG. 8 depicts an exemplary software lookup table. A look-up table is a software construction that correlates the output of one lens channel versus the other versus the overall brightness of the fixture. By way of exemplification, in one embodiment, if a person turned the two knobs (spot/flood 114 and output 16) in order to achieve a low output level and a very narrow spot setting, that would correlate to location k1j1 in the table. The software stored in association with the processor looking at this lookup table location would cause the fixture to turn the Spot channel on at 1% (or something) and the flood channel at 0%. Correspondingly, if someone wanted about an even mix of spot and flood and the brightest that the panel could achieve, knob 14 would be positioned to the knj(n/2) which might correlate to 50% spot and 50% flood. The lookup table's flexibility helps to accommodate for any non-linear behavior in the range of the lens outputs, which generally becomes more important as more channels are added.

Dim curves are arrived at both empirically and mathematically. Such curves are preferably entered into the lookup table stored in a database in memory accessible by the processor contained in the housing of light panel 10. To achieve a perceptually smooth transition, the software control by the processor of the independent "Spot" and "Flood" channels is tailored to match the brain's ability to perceive the region within the beam and field where discontinuities occur.

Figure 7:
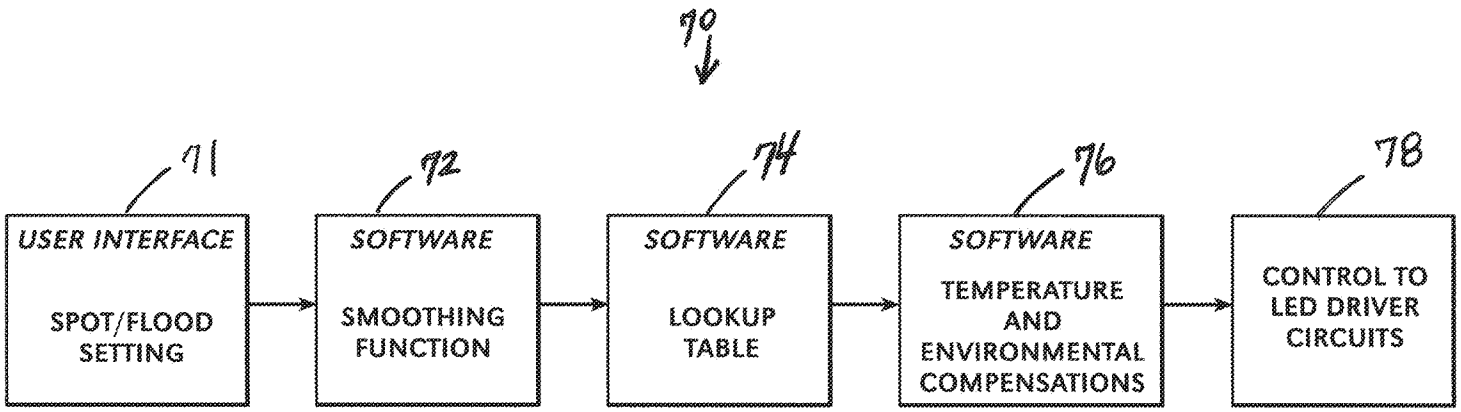
FIG. 7 is a flow chart illustrating the method of the present disclosure.

As shown in FIG. 7, a method for multi-channel multi-lens operation shall next be described. Data may be provided via the user interface (such as knob 14 of FIG. 2) for Spot/Flood settings at 70. Depending upon the data provided, undesired contrasts may be introduced between adjacent settings. A smoothing function 72 may be employed to reduce or eliminate hard contrasts between settings while retaining all or part of the relative highest and lowest ranges of each. This smoothing function is described below in greater detail in association with FIG. 11. The smoothed values may be accessed by the processor from the stored lookup table (e.g., FIG. 8) for future use at 74. The smoothing function or functions and generation of or access to the lookup table may be based on software programming. Having the lookup table available before values from the table are actually used to control or drive the LEDs reduces time and processor requirements. Compensation may be applied through programming for temperature and environmental considerations at 76. Compensation for temperature and environment may also preferably be a software function and may be in conjunction with the/a lookup table. These values from the lookup table (temperature and/or environmentally compensated) may then be used to control LED driver circuitry at 78. The above described method may be operated using general purpose or otherwise programmable hardware which may be housed in light panel 10 of FIGS. 1 and 2.

Figure 11:
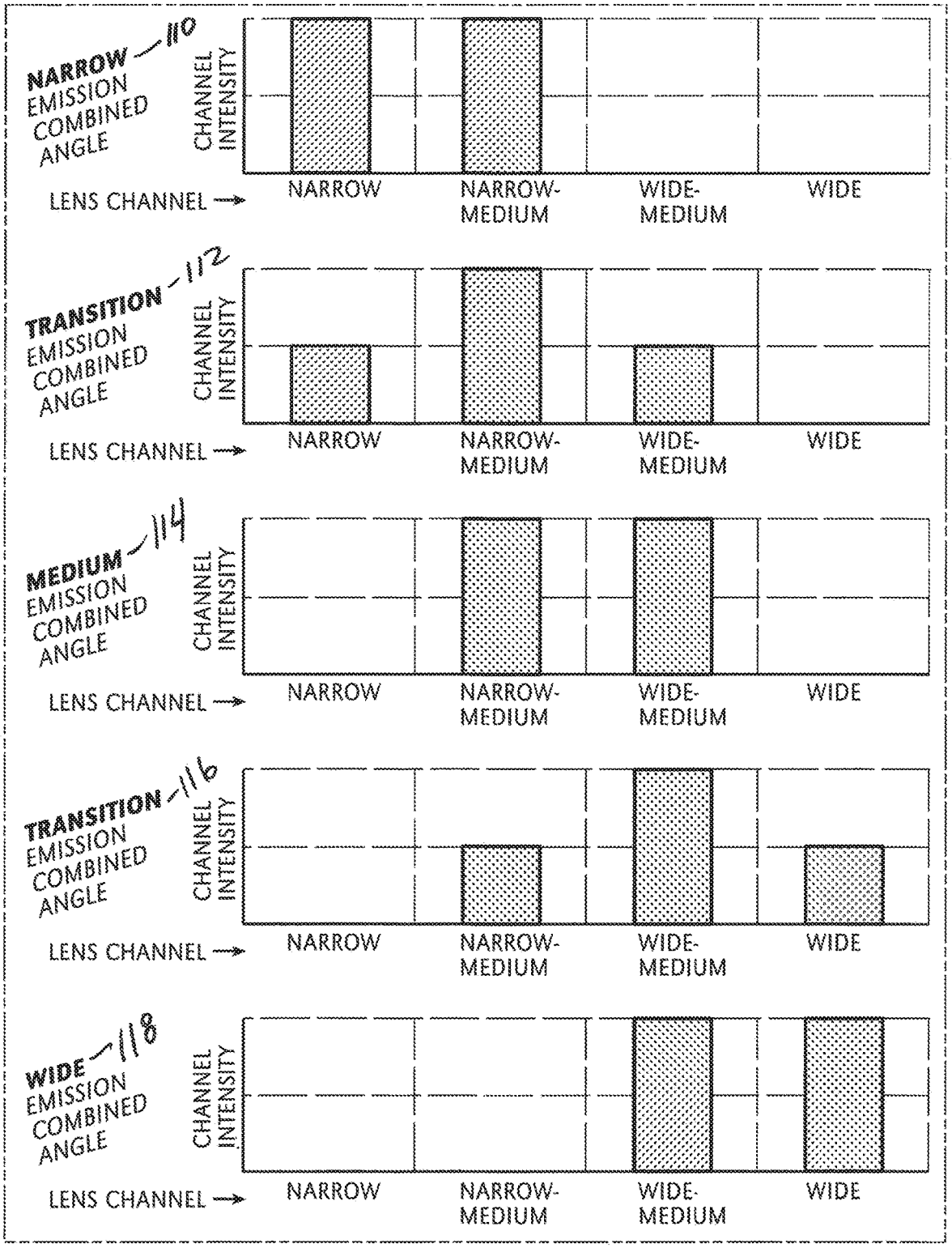
FIG. 11 depicts channel intensity over a transition between the four beam angles of FIG. 9.

With reference to FIG. 11, the smoothing function of the present method shall next be described/exemplified. This smoothing function of the present disclosure is intended to produce blended, homogeneous, light across the panel array (100 of FIG. 10) using multiple lenses, lens channels. This results in even and smooth adjustment (transition) between the multiple channels (beam angles).

An exemplary preferred transition between a narrow lens emission (spot) 110 to a medium lens emission 114 to a wide lens emission (flood) 116 is depicted in FIG. 11. As shown, narrow emission combined angle 110 depicts a state wherein the LED bulbs on a lens channel positioned to emit light through narrow lenses (such as lenses 92 of the module of FIG. 9 in the array of FIG. 10) as well as LEDs positioned to emit light through narrow-medium lenses (such as lenses 94 of the module of FIG. 9 in the array of FIG. 10) are actuated with maximum channel intensity (per the lookup table of FIG. 8). In an example where lenses 92 produce a beam angle of 10°, and lenses 94 produce a beam angle of 25°, a narrow emission combined angle 110 state is achieved. In this state, LEDs positioned to emit light through medium-wide lenses (such as lenses 96 of module 90 of FIG. 9 in the array 100 of FIG. 10) and the LEDs positioned to emit light through wide lenses (such as lenses 98 of module 90 of FIG. 9 in array 100 of FIG. 10) are not activated and produce 0% channel intensity (per lookup table of FIG. 8).

As the input selection (such as knob 14 of FIG. 2) is transitioned from spot toward a state of medium emission combined angle 114, a state of transition emission combined angle 112 is briefly attained. In transition state 112, the LEDs on a lens channel positioned to emit light through narrow lenses (such as lenses 92 of the module of FIG. 9 in the array of FIG. 10) are actuated at medium channel intensity (50%) per the lookup table of FIG. 8. The LEDs on a lens channel positioned to emit light through narrow-medium lenses (such as lenses 94 of the module of FIG. 9 in the array of FIG. 10) remain actuated at maximum channel intensity (per the lookup table of FIG. 8). In addition, in this example, the LEDs on a lens channel positioned to emit light through wide-medium lenses (such as lenses 96 of the module of FIG. 9 in the array of FIG. 10) are actuated at mid (such as 50%) channel intensity.

Following transition 112, if the input is set (knob 14 of FIG. 2) at a position of medium emission combined angle, the state depicted as 114 is achieved. In this state, the LED on a lens channel positioned to emit light through narrow lenses (such as lenses 92 of the module of FIG. 9 in the array of FIG. 10) are not actuated (0% channel intensity). The LEDs on a lens channel positioned to emit light through narrow-medium lenses (such as lenses 94 of the module of FIG. 9 in the array of FIG. 10) are actuated to full channel intensity (100%). The LEDs on a lens channel positioned to emit light through wide-medium lenses (such as lenses 96 of the module of FIG. 9 in the array of FIG. 10) are also actuated at full channel intensity (100%). The LEDs on a lens channel positioned to emit light through wide lenses (such as lenses 98 of the module of FIG. 9 in the array of FIG. 10) are not actuated (0% channel intensity).

As the input selector (such as knob 14 of FIG. 2) is then transitioned from medium emission combined angle 114, toward a state of wide emission combined angle 116, a state of transition emission combined angle 116 is achieved. In transition state 116, the LEDs on a lens channel positioned to emit light through narrow-medium lenses (such as lenses 94 of the module of FIG. 9 in the array of FIG. 10) are actuated at half channel intensity (50%) per the lookup table of FIG. 8). The LEDs on a lens channel positioned to emit light through wide-medium lenses (such as lenses 96 of the module of FIG. 9 in the array of FIG. 10) are actuated at maximum (100%) channel intensity (per lookup table of FIG. 8). In addition, in this example transition, the LEDs on a lens channel positioned to emit light through wide lenses (such as lenses 98 of the module of FIG. 9 in the array of FIG. 10) are actuated at medium (such as 50%) channel intensity.

Following transition 116, if the input is set (knob 14 of FIG. 2) at a position of wide emission combined angle, the state depicted as 118 is achieved. In this state, the LEDs on a lens channel positioned to emit light through narrow lenses (such as lenses 92 of the module of FIG. 9 in the array of FIG. 10) are not actuated (0% channel intensity. The LEDs on a lens channel positioned to emit light through narrow-medium lenses (such as lenses 94 of the module of FIG. 9 in the array of FIG. 10) are also not actuated (0% channel intensity). The LEDs on a lens channel positioned to emit light through wide-medium lenses (such as lenses 96 of the module of FIG. 9 in the array of FIG. 10) are actuated at full channel intensity (100%) per the lookup table of FIG. 8.

The LEDs on a lens channel positioned to emit light through wide lenses (such as lenses 98 of the module 90 of FIG. 9 in the array 100 of FIG. 10) are also actuated at full channel intensity (100%) per the lookup table of FIG. 8.

It will be understood by one of skill in the art that if dimmer knob (such as knob 16 of FIG. 2) is positioned such that the light output is less than full power, the maximum (100%) and mid (50%) intensities will be less per the lookup table of FIG. 8. However, for the purpose of FIG. 11, and for the purpose of exemplification, the intensities of FIG. 11 will be maximum (100%), mid (50%) or zero (0%) for the selected output as derived from the lookup table. In addition, the channel intensities set forth above are for the purpose of exemplification and could be other than maximum, mid and zero and could vary along the transition as required to achieve the objects set forth.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A multiple channel lens combination multi-focus LED lighting fixture, comprising:

a light panel;

a processor;

at least one module including a plurality of LEDs each adapted to project light at an intensity through an immovable lens and at least three said lenses each projecting said light at a different beam angle;

said at least one module immovably fixed in said light panel;

at least three channels each in electrical communication with said processor;

said at least three channels each in electrical communication with at least one of said plurality of LEDs;

each of said at least three channels corresponding to a different beam angle;

said processor adapted to independently drive each of said plurality of LEDs through its associated channel to provide variation in the beam angle of light projected from said light panel and to provide blended, homogeneous light projected across said light panel for each said variation in beam angle.

2. A method of controlling LED driver circuitry for a multi-focus LED lighting fixture, comprising:

providing a processor, at least one module including a plurality of fixed LEDs each adapted to project light at an intensity through a fixed lens and at least three said lenses each projecting said light at a different beam angle, at least three channels each in electrical communication with said processor such that said at least three channels are each in electrical communication with at least one of said plurality of LEDs, each of said at least three channels corresponding to a different beam angle, and said processor adapted to independently drive each of said plurality of LEDs through its associated channel;

each said channel adapted to be operated simultaneously and at varying intensities;

providing data to said processor relating to a desired intensity of light to be projected through each said lens in its associated channel;

said processor performing a smoothing function to reduce contrasts between light projected by said plurality of LEDs at various intensities and beam angles;

controlling said plurality of LEDs via said processor in response to said data and said smoothing function.

3. The lighting fixture of claim 1 including multiple lenses of each beam angle.

4. The lighting fixture of claim 1 wherein said module includes multiple lenses of each beam angle associated with a respective channel.

5. The lighting fixture of claim 4 wherein said lenses are configured in an array in said module.

6. The lighting fixture of claim 5 including a plurality of modules forming said panel.

7. The lighting fixture of claim 6 wherein said panel is secured in a housing.

8. The lighting fixture of claim 1 wherein said beam angles vary between spot and flood.

9. The lighting fixture of claim 1 wherein said plurality of LEDs are dimmable.

10. The lighting fixture of claim 1 wherein said processor is adapted to independently vary the intensity of said light projected by said LEDs by channel.

11. The lighting fixture of claim 10 further including a DMX controller in communication with said processor and adapted for varying said intensity.

12. The lighting fixture of claim 10 further including a manual control dial in communication with said processor for varying said intensity.

13. The lighting fixture of claim 1 wherein said fixture is powered by a battery.

14. The lighting fixture of claim 1 including four channels.

15. The lighting fixture of claim 14 wherein the beam angles of said lenses vary between 8 degrees and 120 degrees.

16. The lighting fixture of claim 14 wherein the beam angles of said lenses vary between 10 degrees and 80 degrees.

17. The method of claim 2 further including compensating for temperature and environmental conditions.

18. The method of claim 17 further including varying the beam angles between spot and flood.

19. The method of claim 18 further including varying the beam angles between 8 degrees and 120 degrees.

20. The method of claim 18 further including weighting the intensities in order to minimize contrasts.

* * * * *